US007762537B2

(12) United States Patent
Kato et al.

(10) Patent No.: US 7,762,537 B2
(45) Date of Patent: Jul. 27, 2010

(54) SHEET PROCESSING APPARATUS AND METHOD

(75) Inventors: Hitoshi Kato, Toride (JP); Wataru Kawata, Kashiwa (JP); Keiko Fujita, Kashiwa (JP); Youichi Chikugo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 238 days.

(21) Appl. No.: 11/759,137

(22) Filed: Jun. 6, 2007

(65) Prior Publication Data

US 2007/0287622 A1 Dec. 13, 2007

(30) Foreign Application Priority Data

Jun. 9, 2006 (JP) ..... 2006-161535

(51) Int. Cl.
*B41L 43/12* (2006.01)
*B65H 33/04* (2006.01)
*B65H 39/00* (2006.01)
*B26D 5/20* (2006.01)

(52) U.S. Cl. ..... 270/37; 270/58.07; 270/58.08; 270/58.09; 83/76.5

(58) Field of Classification Search ..... 270/37, 270/58.07, 58.08, 58.09
See application file for complete search history.

(56) References Cited

U.S. PATENT DOCUMENTS

| | | | | |
|---|---|---|---|---|
| 3,600,993 | A * | 8/1971 | Williams et al. | 83/76.5 |
| 5,241,483 | A * | 8/1993 | Porret et al. | 700/125 |
| 6,532,856 | B2 * | 3/2003 | Kato et al. | 83/934 |
| 6,851,666 | B2 * | 2/2005 | Nagao et al. | 270/37 |
| 7,419,149 | B2 * | 9/2008 | Oota et al. | 270/52.17 |
| 2004/0170462 | A1 * | 9/2004 | Awano | 400/621 |
| 2004/0218217 | A1 * | 11/2004 | Dechamps | 358/1.18 |

FOREIGN PATENT DOCUMENTS

JP 3012298 U 4/1995

* cited by examiner

*Primary Examiner*—Gene Crawford
*Assistant Examiner*—Yolanda Cumbess
(74) *Attorney, Agent, or Firm*—Canon USA Inc IP Division

(57) ABSTRACT

A sheet processing apparatus is operable to cut an edge portion of a sheet. The sheet processing apparatus is operable to calculate a sheet utilization efficiency based on an area of the sheet before cutting and an area of a sheet obtained by cutting the edge portion.

16 Claims, 12 Drawing Sheets

SHEET PROCESSING APPARATUS AND METHOD

BACKGROUND OF THE INVENTION

1. Field of the Invention

The present invention generally relates to a sheet processing apparatus. More particularly, the present invention relates to a sheet processing apparatus capable of cutting a sheet.

2. Description of the Related Art

With a conventional image forming apparatus, such as a copying machine, a printer, a facsimile, and a multifunction peripheral including functions of such apparatuses, a booklet-like sheet stack can be obtained in the following manner. After sheets output from an image forming apparatus body are stacked, the sheet stack is bound with a stapler at one or two positions. Then, the bound sheet stack is folded at the stapled positions to produce a booklet.

In recent years, post-processing of a print product is performed in various different ways as in the case of, for example, producing a booklet to be inserted into an envelope. For example, in outputting a small size bound sheet stack, it may be desirable to cut a large regular-size sheet into a number of small size sheets. In this regard, Japanese Utility Model Registration No. 3012298 discusses a paper cutting apparatus configured to cut a large size sheet into small size sheets.

In cutting a large regular-size sheet into small size sheets, waste cut-off sheets may be generated due to the difference between the size of the large regular-size sheet and the size of the small size sheet. In this regard, however, a conventional paper cutting apparatus merely cuts a sheet into a desired size sheet and does not support bookbinding processing after cutting a sheet stack. Accordingly, the conventional paper cutting apparatus cannot calculate a sheet size according to which an amount of waste cut-off sheets generated during a cutting operation is minimized or decreased. Thus, to minimize or decrease an amount of waste cut-off sheets, a relatively complex computation is required to be manually performed by a user to select or determine an optimal sheet size to be cut with the conventional paper cutting apparatus.

Furthermore, in producing a small size bound sheet stack with a conventional paper cutting apparatus, the number of times of folding a large size sheet is limited to one. Thus, only a small number of pages can be obtained from one large size sheet. Accordingly, when a desired sheet size is smaller than the size of a sheet obtained by folding a large size sheet once, an excessive amount of waste cut-off sheets can be generated.

SUMMARY OF THE INVENTION

An embodiment of the present invention is directed to a sheet processing apparatus capable of utilizing a sheet such that an amount of waste cut-off sheets generated during a cutting operation is minimized or reduced.

According to an aspect of the present invention, a sheet processing apparatus includes a cutting unit configured to cut an edge portion of a sheet, and a calculation unit configured to calculate a sheet utilization efficiency based on an area of the sheet before cutting and an area of a sheet obtained by cutting the edge portion by the cutting unit.

According to another aspect of the present invention, a sheet processing apparatus includes a cutting unit configured to cut an edge portion of the sheet, and a sheet size selection unit configured to select a size of sheet to be processed based on an area of the sheet before cutting and an area of a sheet obtained by cutting the edge portion by the cutting unit.

According to an exemplary embodiment of the present invention, sheets can be efficiently used without generating an excessive amount of waste cut-off sheets.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principle of the invention.

DETAILED DESCRIPTION OF THE EMBODIMENTS

Various exemplary embodiments, features and aspects of the present invention will now herein be described in detail with reference to the drawings. It is to be noted that the relative arrangement of the components, the numerical expressions, and numerical values set forth in these embodiments are not intended to limit the scope of the present invention unless it is specifically stated otherwise.

Figure 1:
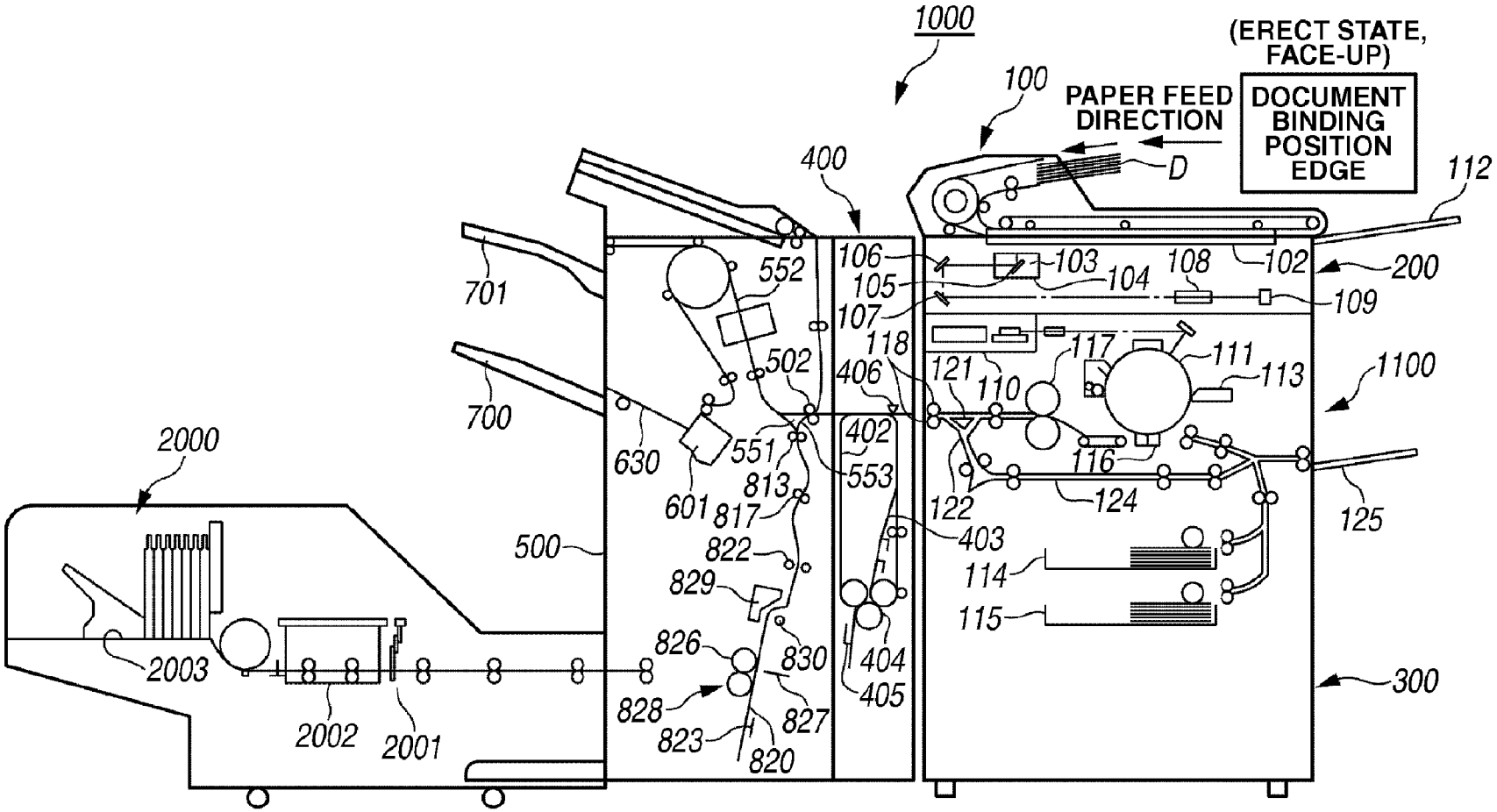
FIG. 1 is a cross section of an image forming apparatus as viewed in a sheet conveyance direction according to an exemplary embodiment of the present invention.

FIG. 1 is a cross section of an image forming apparatus 1000 that is one example of a sheet processing apparatus as viewed in a sheet conveyance direction according to an exemplary embodiment of the present invention.

The image forming apparatus 1000 includes an image forming apparatus body 1100, a folding machine 400, a finisher 500, and a cutting unit 2000. The image forming apparatus body 1100 includes a document feeder 100, an image reader 200, and a printer 300. The document feeder 100 and the image reader 200 are not always necessary. The image forming apparatus body 1100 can form an image based on an external signal with the printer 300.

The document feeder 100 conveys documents D that are set thereon sheet by sheet from the first page from left to right in FIG. 1 on a platen glass 102 via a curved path and then discharges the documents onto a discharge tray 112. During this operation, a scanner unit 104, which is stationary at a predetermined position, reads the document passing from left to right in FIG. 1.

When a document passes the scanner unit 104, light emitted from a lamp 103 of the scanner unit 104 illuminates the document, and light reflected from the document is guided to an image sensor 109 via mirrors 105, 106, and 107 and a lens 108. When the user sets a document on the platen glass 102 without using the document feeder 100, the image reader 200 can read the set document while moving from left to right in FIG. 1.

The image of the document read with the image sensor 109 is subjected to image processing, and the processed image is then sent to an exposure control unit 110. The exposure control unit 110 outputs a laser beam according to an image signal. The laser beam is irradiated onto the surface of a photosensitive drum 111, which is an image forming member, to form an electrostatic latent image on the surface of the photosensitive drum 111. The electrostatic latent image formed on the surface of the photosensitive drum 111 is developed with toner by a development device 113 to form a toner image. The toner image formed on the photosensitive drum 111 is transferred by a transfer unit 116 onto a sheet fed from any one of cassettes 114 and 115, a manual feed unit 125, and a two-sided conveyance path 124.

Figure 2:
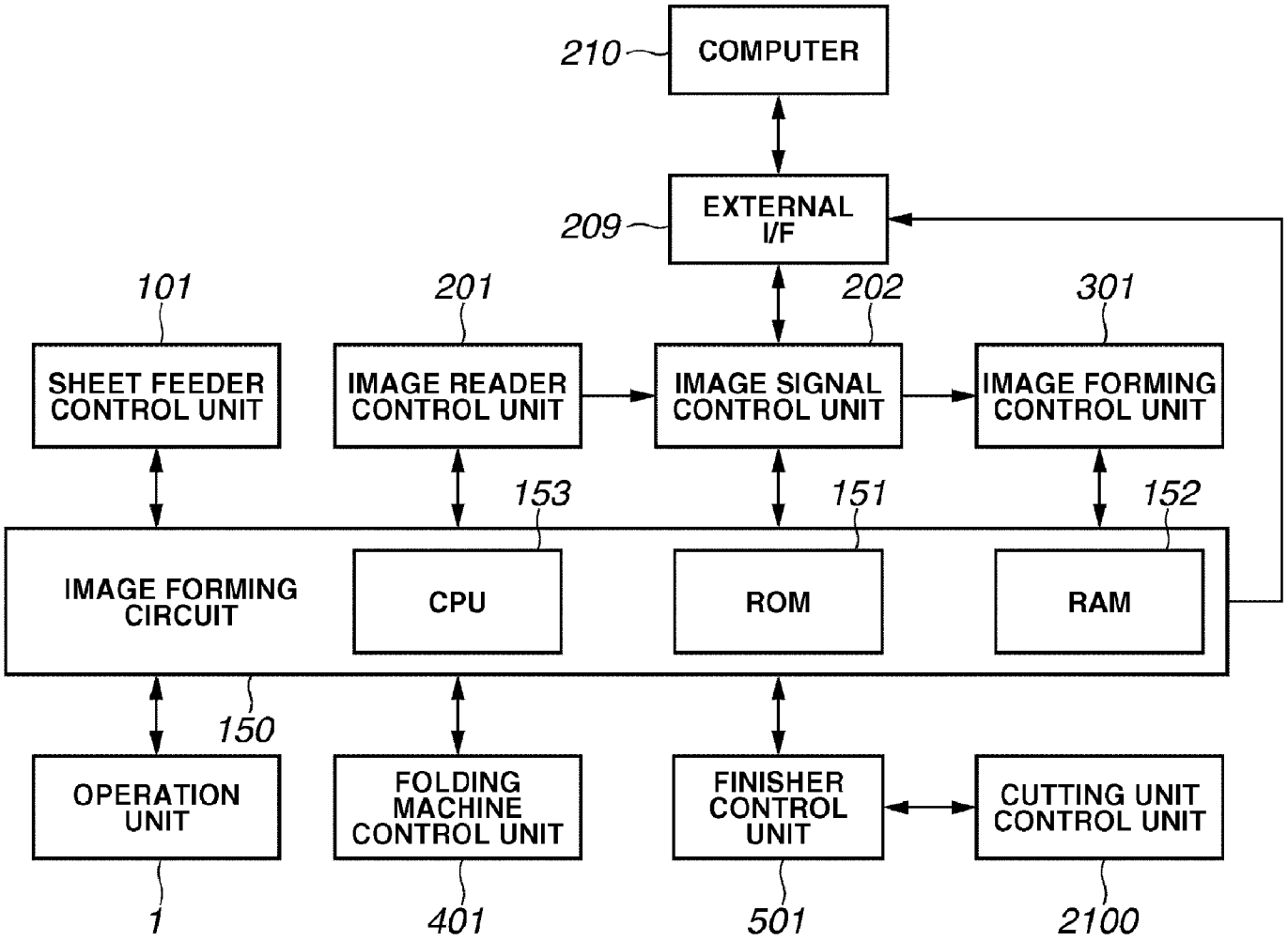
FIG. 2 is a control block diagram of the image forming apparatus according to an exemplary embodiment of the present invention.

The user can enter a type of sheet to be fed from the manual feed unit 125 or the cassettes 114 and 115, such as, for example, a thick paper or an overhead projector (OHP) sheet, via an operation unit 1 (FIG. 2). In the printer 300, an image forming circuit 150 (FIG. 2) selects an optimum conveyance condition and an image forming condition according to the sheet type.

The toner image transferred onto the sheet is fixed by a fixing unit 117. The sheet that has passed the fixing unit 117 is temporarily guided to a path 122 by a flapper 121. Then, after a trailing edge of the sheet passes through the flapper 121, the sheet is guided to a discharge roller 118 by the flapper 121. Thus, the sheet is switched back to be conveyed. The sheet is conveyed with a side having the toner image formed thereon facing down and is discharged from the printer 300 by the discharge roller 118.

The sheet discharged from the discharge roller 118 is conveyed into the folding machine 400. The folding machine 400, which is also referred to herein as a folding unit, can fold the sheet in three-folded sections in a Z-like shape or fold the sheet in a single-fold configuration (also referred to herein as "once-folding"). In a case where an A3 size or B4 size sheet is designated to be subjected to Z-like shape folding processing or where the sheet is designated to be cut into smaller size sheets and a double-fold configuration (also referred to herein as "twice-folding") is requested, the folding machine 400 performs the requested folding processing on the sheet. It is noted that sheets can be conveyed into the finisher 500 without being folded by the folding machine 400.

The finisher 500 includes an inlet roller pair 502 that guides the sheet discharged from the printer 300 via the folding machine 400. On the downstream side of the inlet roller pair 502, a switching flapper 551 that guides the sheet into a finisher path 552 or a first bookbinding path 553 is disposed.

The sheet conveyed from the first bookbinding path 553 is stacked onto a bookbinding processing tray 820 via a first conveyance roller pair 813 and a second conveyance roller pair 817. The sheet is further conveyed by a third conveyance roller 822 until the leading edge of the sheet contacts a movable sheet positioning member 823. Two pairs of staplers 829, which serve as a binding unit, are disposed on the downstream side of the second conveyance roller pair 817 in the conveyance direction. The staplers 829 operate in cooperation with an anvil 830 disposed at a position opposite to the staplers 829 to bind a sheet stack at a center portion thereof with staples. The staplers 829 can move in a direction orthogonal to the sheet conveyance direction and can freely change a staple position according to a booklet configuration to be produced.

A folding roller pair 826 is disposed on the downstream side of the staplers 829. The folding roller pair 826 pinches a sheet stack that is extruded by an extrusion member 827. Then, the folding roller pair 826 conveys and folds the sheet stack to feed the sheet stack to the cutting unit 2000. The folding roller pair 826 and the extrusion member 827 constitute a sheet stack folding apparatus 828, which is a folding unit.

In the cutting unit 2000, a cutter 2001 cuts off a trailing edge portion (upstream edge portion) of the sheet stack. Thus, a pouched portion on the trailing edge of a sheet twice-folded by the folding machine 400 and the sheet stack folding apparatus 828 is cut off in a method described later below, thus forming pages that can be turned over. Then, a cutter 2002 cuts off the side edge portions of the sheet stack and cuts the sheet stack along a direction parallel to the sheet conveyance direction to divide the sheet stack into two. Thus, the cutting unit 2000 cuts the sheet stack into a designated size.

In addition, the image forming apparatus 1000 can stack a sheet stack onto an intermediate tray 630, bind the sheet stack at its edge portion by using a stapler 601, and discharge the bound sheet stack onto a tray 700 or a tray 701.

FIG. 2 is a control block diagram of the image forming apparatus 1000. Referring to FIG. 2, the image forming circuit 150 includes a central processing unit (CPU) 153. The CPU 153 controls each control unit according to a program stored in a read-only memory (ROM) 151 and settings defined via the operation unit 1. The image forming apparatus 1000 includes various control units, such as a sheet feeder control unit 101, an image reader control unit 201, an image signal control unit 202, an image forming control unit 301, a folding machine control unit 401, a finisher control unit 501, and an external interface (I/F) 209.

The sheet feeder control unit 101 controls the document feeder 100. The image reader control unit 201 controls the image reader 200. The image forming control unit 301 controls the printer 300. The folding machine control unit 401 controls the folding machine 400. The finisher control unit 501 controls the finisher 500. The finisher control unit 501 also controls a cutting unit control unit 2100. The cutting unit control unit 2100 controls the cutting unit 2000.

A random access memory (RAM) 152 is used as a temporary storage area for temporarily storing control data and a work area for calculation performed during control. The external I/F 209, which is an interface with a computer 210, rasterizes print data into image data and outputs the image data to the image signal control unit 202. Image data read with the image sensor 109 is output from the image reader control unit 201 to the image signal control unit 202. Image data output from the image signal control unit 202 to the image forming control unit 301 is supplied to the exposure control unit 110.

Figure 3:
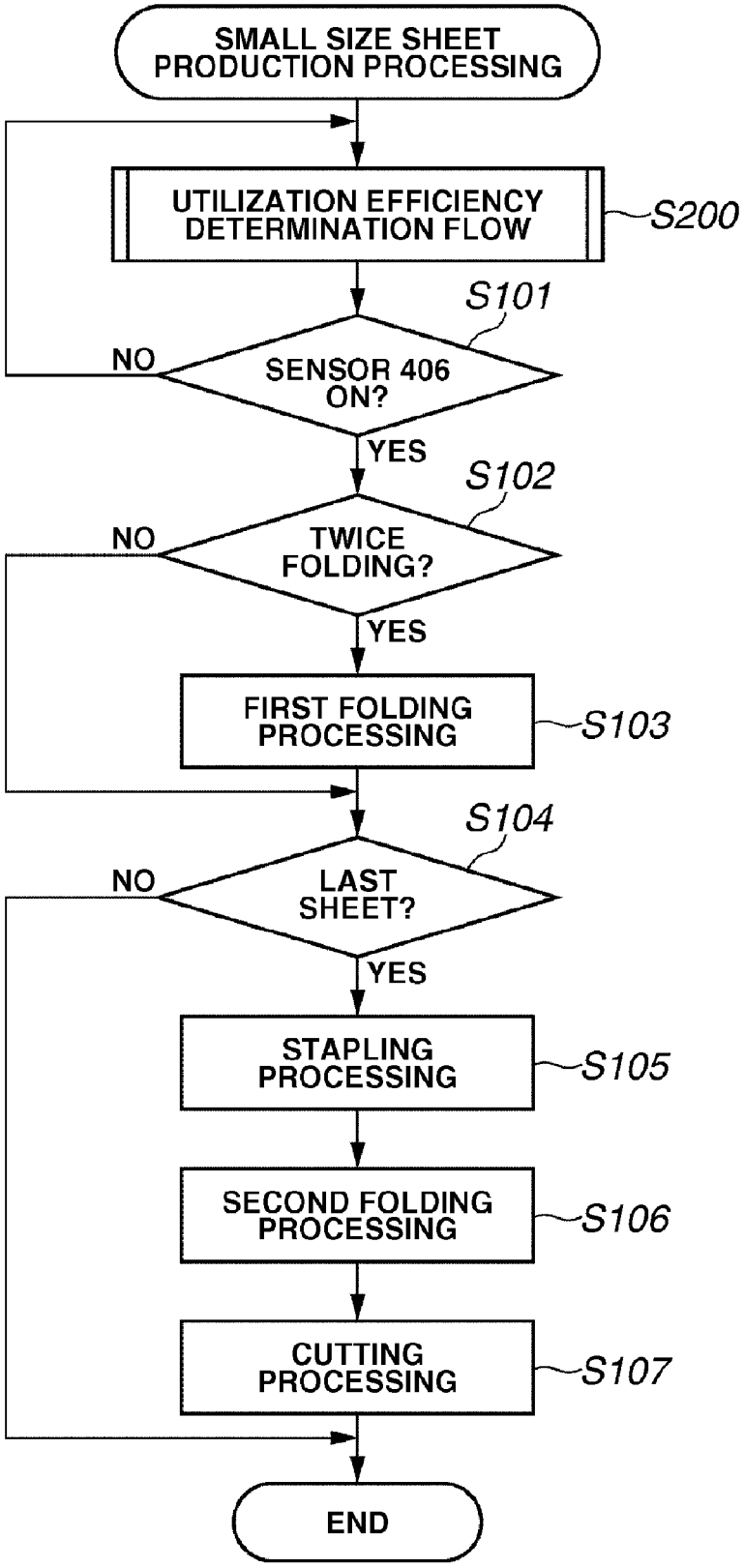
FIG. 3 is a flow chart illustrating an operation for producing a booklet according to an exemplary embodiment of the present invention.

FIG. 3 is a flow chart illustrating an operation for producing a booklet. Processing illustrated in the flow chart in FIG. 3 is performed every time a sheet is conveyed from the image forming apparatus body 1100 to the folding machine 400 and then to the finisher 500.

Figure 5:
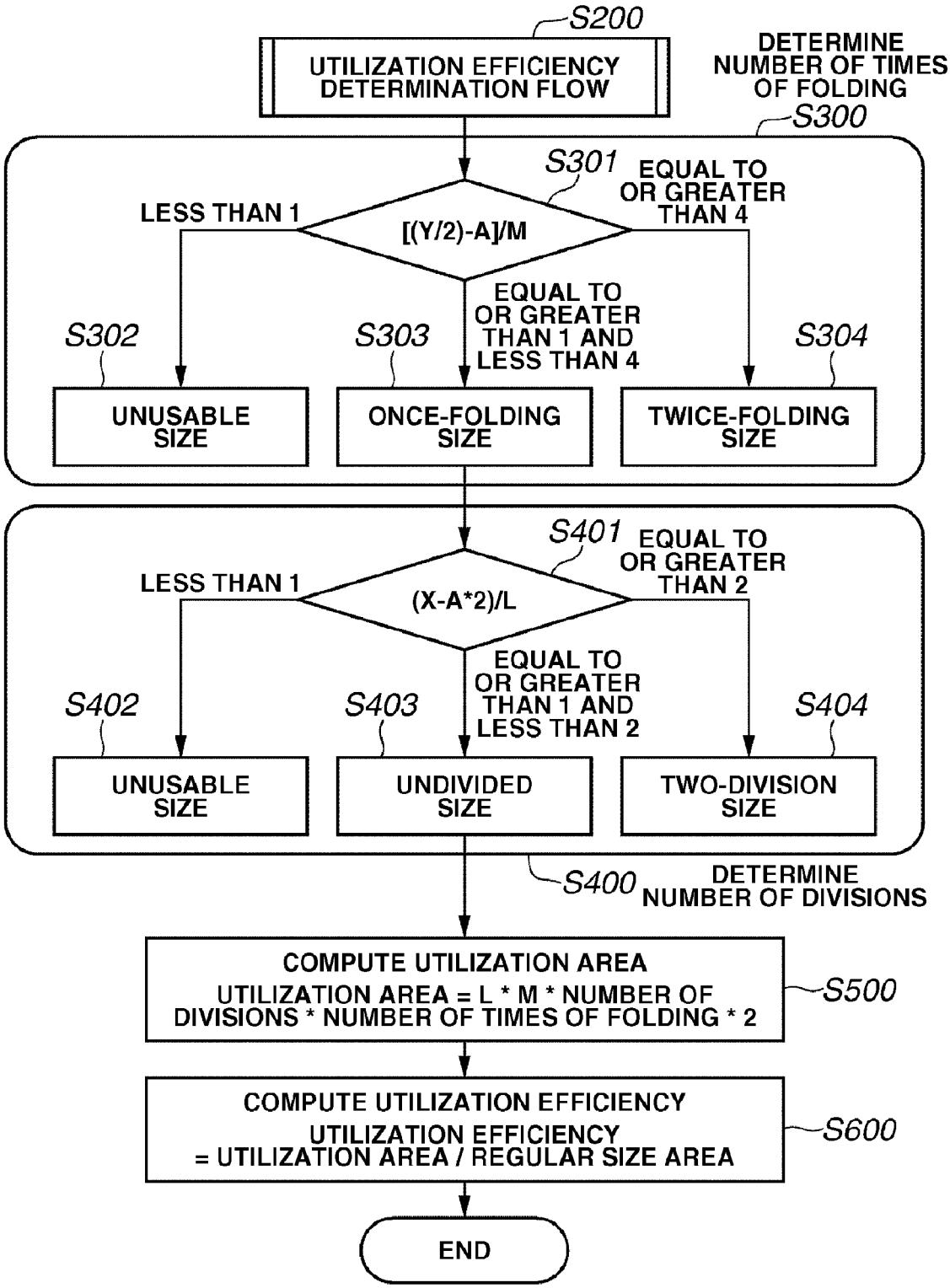
FIG. 5 is a flow chart illustrating processing for a control operation performed during utilization efficiency determination processing according to an exemplary embodiment of the present invention.

Referring to FIG. 3, first, the image forming circuit 150 calculates the number of times a sheet is to be folded based on various information for binding a sheet stack entered by the user and processing for determining the number of times of folding in step S300 in a flow chart in FIG. 5 in a utilization efficiency determination flow in step S200. In step S101, the folding machine control unit 401 waits for an input from an inlet sensor 406, which is disposed in an inlet portion of the finisher 500. In step S102, when the inlet sensor 406 is turned on, the folding machine control unit 401 detects the number of times of folding based on a signal from the image forming circuit 150.

If, in the processing for determining the number of times of folding in step S300, it is determined that the number of times of folding is 2, it is necessary to fold the sheet twice. That is, the folding machine 400 folds the sheet once and the finisher 500 further folds the folded sheet once. On the other hand, if, in the processing for determining the number of times of folding in step S300, it is determined that the number of times of folding is 1, the sheet is folded only once by the finisher 500, while the folding machine 400 does not perform folding. The sheet that is once-folded is doubled in the thickness direction. The sheet that is twice-folded is quadruplicated in the thickness direction.

Figure 4A:
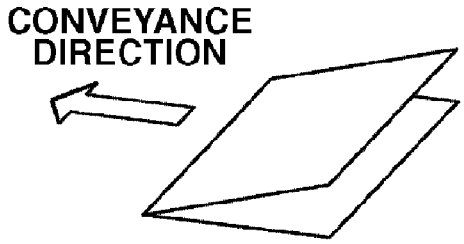
FIGS. 4A through 4E illustrate a sequence for producing a booklet according to an exemplary embodiment of the present invention.

If it is determined in step S102 that the number of times of folding is 2, then in step S103, the image forming circuit 150 allows the folding machine 400 to perform first folding processing via the folding machine control unit 401 to fold the sheet as illustrated in FIG. 4A. More specifically, the folding machine 400 conveys the sheet into a folding and conveyance path 402 and allows the sheet to contact a stopper 405 to form a loop. The folding machine 400 folds the loop portion of the sheet with a folding roller 404 to fold the sheet and conveys the folded sheet to the finisher 500 via a folding and conveyance path 403 and a common conveyance path.

The sheet conveyed to the finisher 500 is stacked onto the bookbinding processing tray 820. If it is determined in step S102 that the number of times of folding is 1, the folding machine control unit 401 does not operate the folding machine 400 according to a command from the image forming circuit 150. In this case, the sheet passes through the folding machine 400 without being processed and is stacked onto the bookbinding processing tray 820 of the finisher 500. Sheets stacked onto the bookbinding processing tray 820 are received by the sheet positioning member 823 with their lower edge portions aligned.

In step S104, after the sheets are stacked onto the bookbinding processing tray 820, the finisher control unit 501 checks if the current stacked sheet is the last sheet of the sheet stack. If it is determined in step S104 that the current stacked sheet is not the last sheet of the sheet stack (NO in step S104), then the image forming circuit 150 performs the processing described above on a subsequent sheet. On the other hand, if it is determined in step S104 that the current stacked sheet is the last sheet of the sheet stack (YES in step S104), then in step S105, the image forming circuit 150 operates the staplers 829 to staple the sheet stack received by the sheet positioning member 823.

Figure 4B:
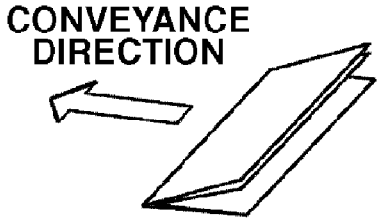

In step S106, the finisher control unit 501 moves the sheet positioning member 823 downward to allow the bound portion of the sheet stack to face the extrusion member 827, and performs second folding processing to fold the sheet stack with the extrusion member 827 and the folding roller pair 826. In this case, the sheet stack that has been subjected to the first folding processing is folded once more. The sheet stack folded twice is quadruplicated in the thickness direction in a state where a pouched portion is formed at the trailing edge thereof, as illustrated in FIG. 4B.

Figure 4C:
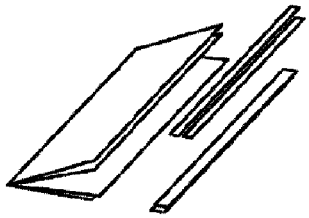

In step S107, the finisher control unit 501 conveys the folded sheet stack to the cutting unit 2000 to perform cutting processing on the folded sheet stack with the cutting unit 2000. In the cutting processing, as illustrated in FIG. 4C, first, the pouched portion at the trailing edge is cut off with the cutter 2001, thus forming pages that can be turned over. The cutting with the cutter 2001 is performed on an edge opposite to the edge that is formed by folding the sheet with the folding roller pair 826. The pouched portion at the trailing edge is formed with a folded portion formed by folding the sheet with the folding machine 400. The cutter 2001 of the cutting unit 2000 cuts off the folded portion formed with the folding machine 400 to produce a booklet having a portion folded with the folding roller pair 826 as its back portion.

Figure 4D:
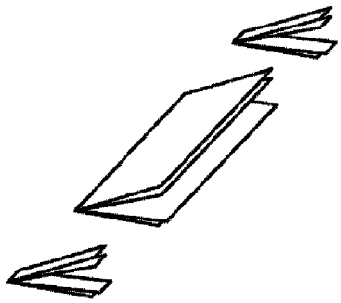
Figure 4E:
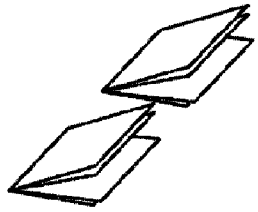

Then, as illustrated in FIG. 4D, the cutter 2002 cuts off both side edges of the sheet stack according to the size of a booklet (the size of a sheet stack after bookbinding). If, as a result of processing for determining the number of divisions in step S400 (FIG. 5) in the processing flow S200, it is determined that the size is a two-division size, then the cutter 2002 cuts the sheet stack in a middle portion between the stapled portions, as illustrated in FIG. 4E. After the cutting operation, the cutting unit 2000 discharges the sheet stack onto a tray 2003, and then the bookbinding processing ends.

FIG. 5 is a flow chart illustrating processing for the utilization efficiency determination flow S200. The processing for the utilization efficiency determination flow S200 is performed by the image forming circuit 150 after a bookbinding mode is set by the user.

Referring to FIG. 5, in step S300, the image forming circuit 150 determines the number of times a sheet is to be folded.

The user enters, via the operation unit 1, values of the length of a feeding sheet in the conveyance direction (Y), a cutting margin (A), and a distance (M) between the back and the fore edge of a booklet. The feeding sheet is a sheet that is to be folded and is stored in either of the cassettes 114 and 115 and the manual feed unit 125.

In step S301, the CPU 153 calculates a numerical value for determining the number of times a sheet is to be folded according to the following expression:

((Y(length of the feeding sheet in the conveyance direction)/2)−A(cutting margin))/M(distance between the back and the fore edge).

Figure 6:
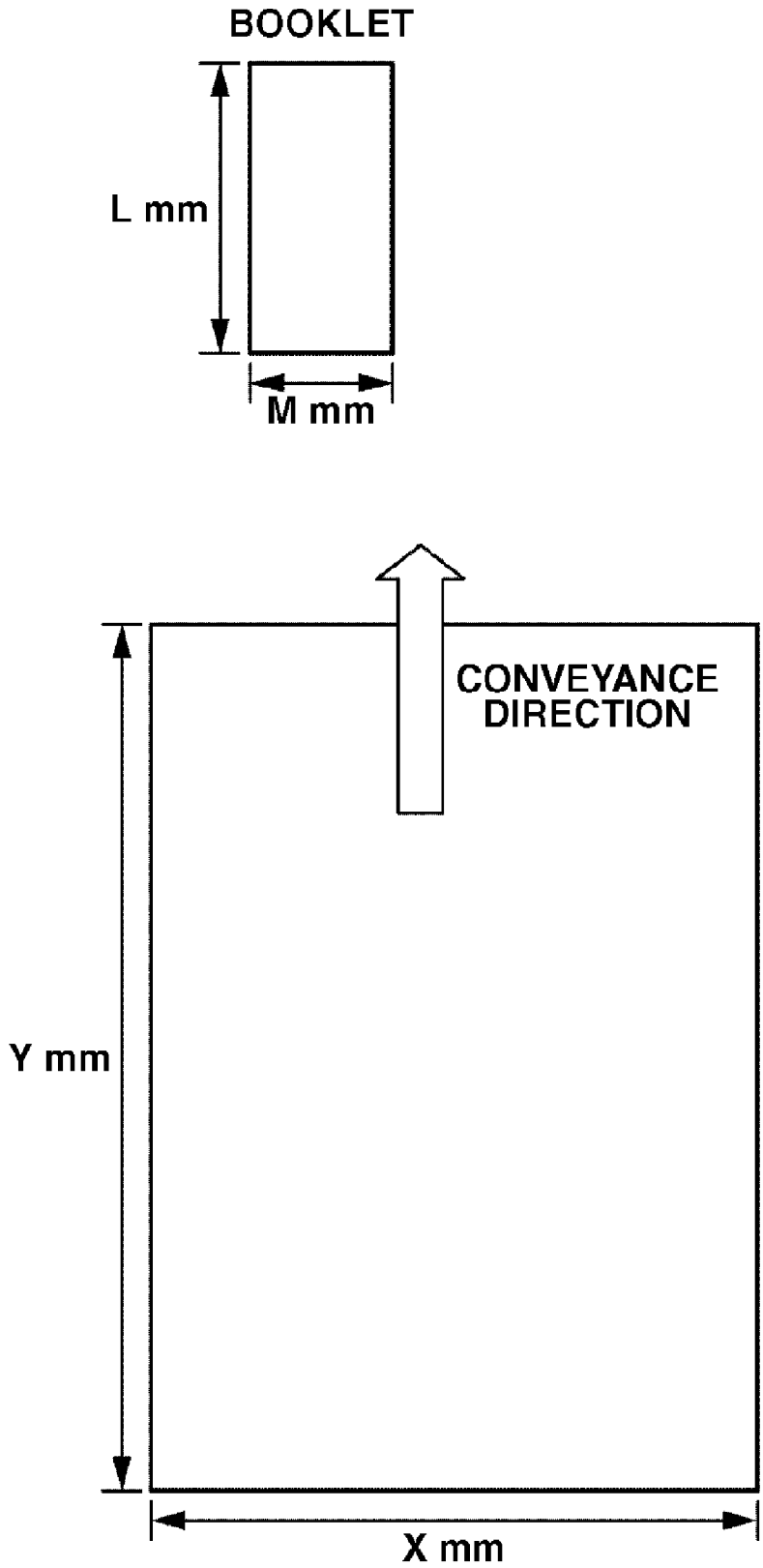
FIG. 6 illustrates variables used in a calculation according to an exemplary embodiment of the present invention.

If it is determined that the numerical value for determining the number of times of folding is less than 1, then in step S302, the CPU 153 determines that the feeding sheet has an unusable size, with which a booklet cannot be produced. If it is determined that the numerical value for determining the number of times of folding is equal to or greater than 1 and less than 4, then in step S303, the CPU 153 determines that the feeding sheet has a once-folding size, with which the feeding sheet can be folded once (the number of times of folding being 1). If it is determined that the numerical value for determining the number of times of folding is equal to or greater than 4, then in step S304, the CPU 153 determines that the feeding sheet has a twice-folding size, with which the feeding sheet can be folded twice (the number of times of folding being 2). As illustrated in FIG. 6, the variable M refers to the length of a sheet in the conveyance direction in a state where the sheet stack has been made into a booklet after being subjected to folding processing and cutting processing. The variable Y refers to the length of a sheet in the conveyance direction that is to be folded.

In step S400, the image forming circuit 150 determines the number of divisions. The processing of "division" refers to division of a sheet stack by cutting the sheet stack on the line along the conveyance direction. The user enters, via the operation unit 1, numerical values of the length of the feeding sheet in a direction orthogonal to the sheet conveyance direction (X) and the length of the back (L).

In step S401, the CPU 153 calculates a numerical value for determining the number of divisions for a booklet according to the following expression:

(X(length of the feeding sheet in the direction orthogonal to the sheet conveyance direction)−A (cutting margin)×2)/L(length of the back).

If the numerical value for determining the number of divisions for a booklet is less than 1, then in step S402, the CPU 153 determines that the feeding sheet has an unusable size, with which a booklet cannot be produced. If it is determined that the numerical value for determining the number of divisions for a booklet is equal to or greater than 1 and less than 2, then in step S403, the CPU 153 determines that the feeding sheet has an undivided size, with which the feeding sheet cannot be divided (that the number of divisions being 1). If it is determined that the numerical value for determining the number of divisions for a booklet is equal to or greater than 2, then in step S404, the CPU 153 determines that the feeding sheet has a two-division size, with which the feeding sheet can be divided into two (the number of divisions being 2). As illustrated in FIG. 6, the variable L refers to the length of a sheet in the direction orthogonal to the conveyance direction in a state where the sheet stack has been made into a booklet after being subjected to folding processing and cutting processing. The variable X refers to the length of a sheet (feeding sheet) in the direction orthogonal to the conveyance direction that is to be folded.

The value "A" (cutting margin) is an assumed minimum value, and is not necessarily equivalent to the actual amount of cutting of the sheet stack. That is, supposing that a utilization efficiency illustrated in FIG. 7, which is described later below, is calculated, for example, as 64% after the number of times of folding and the number of divisions of the sheet are calculated, the ratio of the cutting margin to the sheet before cutting is 36%.

In step S500, the CPU 153 calculates an area of the booklet (utilization area) according to the following expression:

L×M×number of divisions×number of times of folding×2.

In step S600, the CPU 153 calculates a utilization efficiency according to the following expression:

Utilization area/regular size area.

The CPU 153 performs the above-described processing on each regular size sheet or each arbitrary size sheet stacked in the paper feed cassettes to determine a sheet utilization efficiency for each sheet size.

Figure 7:
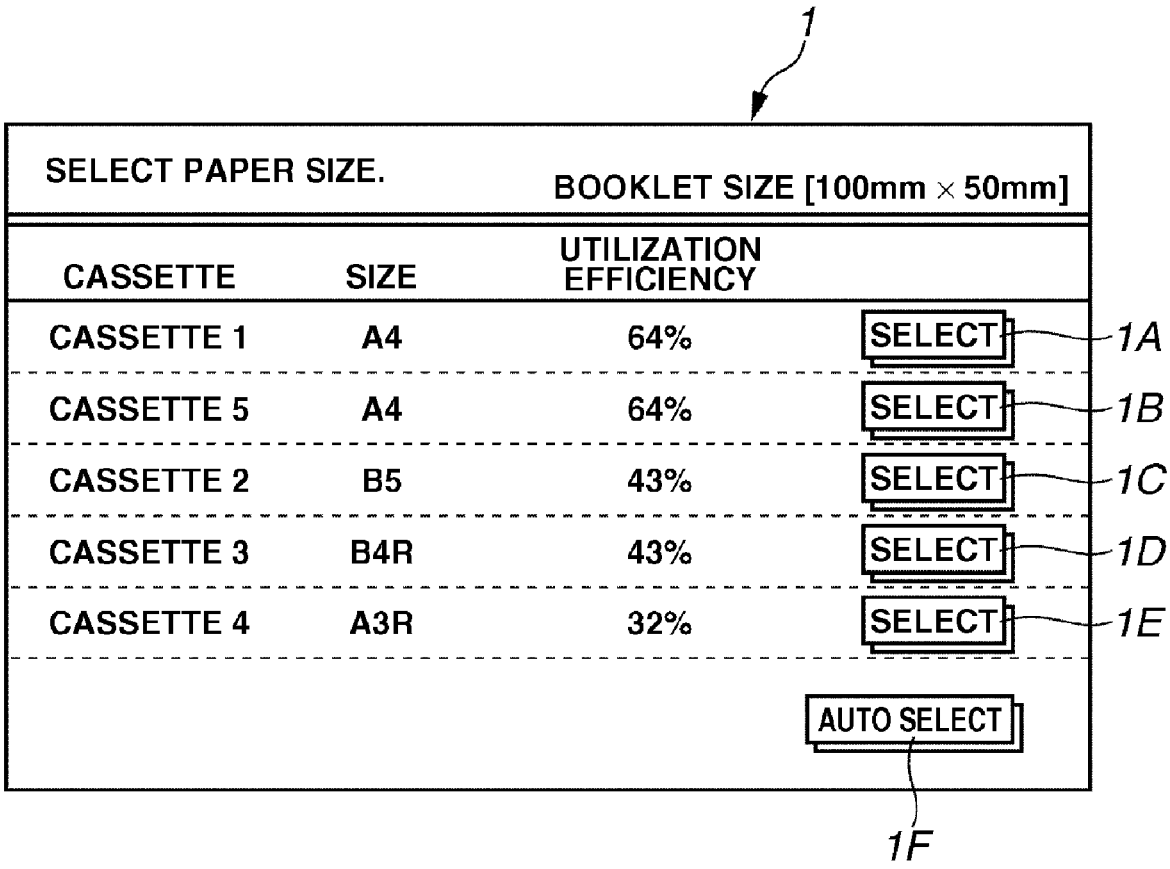
FIG. 7 illustrates an example of a display indicating paper sizes displayed on a display unit according to an exemplary embodiment of the present invention.

The image forming circuit 150 displays a result of calculation performed during the utilization efficiency determination processing on the operation unit 1 (FIG. 2), which is a display unit, in a descending order of utilization efficiency as illustrated in FIG. 7. FIG. 7 illustrates an example in which the utilization efficiencies are displayed for the various size sheets stacked in the paper feed cassettes. However, the utilization efficiencies for all regular sizes or designated regular sizes can be displayed.

In addition, the ratio of cut-off wastes (the amount of waste cut-off sheets) or the area of cut-off wastes can be displayed instead of the utilization efficiency. In this case, the area of cut-off wastes=100%−utilization efficiency (%). For example, in a case where the utilization efficiency is 64%, the area of cut-off wastes is 36%. In this case, the image forming circuit 150 can select a sheet having the highest utilization efficiency to automatically feed the sheet having the highest utilization efficiency from the cassette 114 or 115.

The user can select a feeding sheet size by selecting one of "select" buttons 1A through 1E, which are disposed to the right of the portions indicating the paper sizes to be selected. In addition, the user can select an "auto setting" button 1F to automatically select an optimum feeding sheet size.

In the above-described example, the user enters and sets the size that can be obtained after bookbinding. However, the size that can be obtained after bookbinding can be automatically set by the CPU 153.

A case where an optimum booklet size (the size of a sheet stack after bookbinding) is calculated and displayed based on the size of a designated feeding sheet will now be described below.

The CPU 153 calculates the length of the back (L) according to the following expression:

(X(length of the feeding sheet in the direction orthogonal to the conveyance direction)−2×A (minimum cutting margin))/number of divisions.

In addition, the CPU 153 calculates the distance between the back and the fore edge (M) according to the following expression:

(Y(length of the feeding sheet in the conveyance direction)−number of times of folding×2×A)/(number of times of folding×2).

Figure 8:
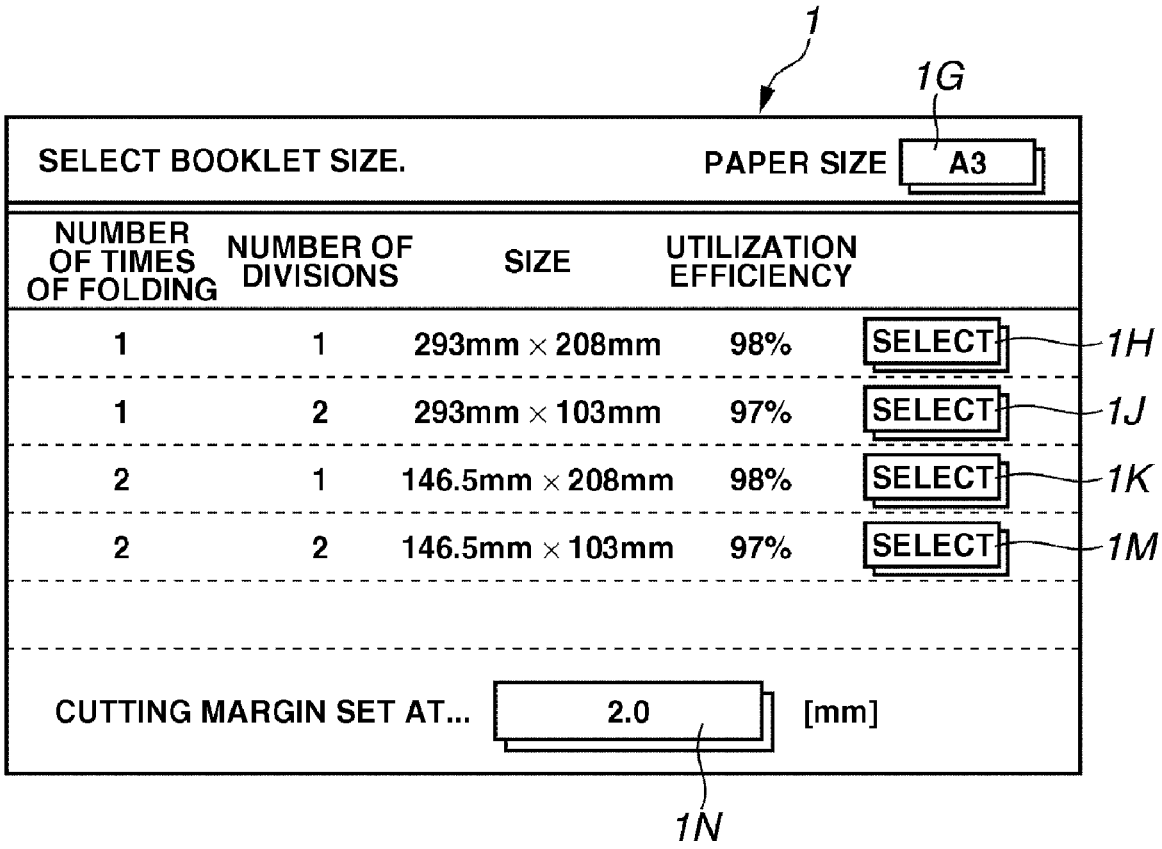
FIG. 8 illustrates an example of a display indicating booklet sizes displayed on a display unit according to an exemplary embodiment of the present invention.

In an embodiment, the CPU 153 performs the above-described calculation under four different conditions ((1) the number of times of folding is 1 and the number of divisions is 1, (2) the number of times of folding is 1 and the number of divisions is 2, (3) the number of times of folding is 2 and the number of divisions is 1, and (4) the number of times of folding is 2 and the number of divisions is 2) to determine the optimum size for a booklet. The CPU 153 then displays the optimum size and the utilization efficiency for each condition, as illustrated in FIG. 8.

The user can select a booklet size by selecting one of "select" buttons 1H through 1M disposed to the right of the field indicating the sizes to be selected. The user can enter a feeding sheet size by selecting a "paper size" button 1G illustrated in FIG. 8. The user can arbitrarily set a cutting margin by entering a numeric value via a "cutting margin" button 1N illustrated in FIG. 8.

It may be necessary to alter an image orientation and a page allocation depending on the case of once-folding performed only with the finisher 500 (where the number of times of folding is 1) and the case of twice-folding performed with the finisher 500 and the folding machine 400 (where the number of times of folding is 2) and depending on the direction of opening a booklet. The opening direction includes "open to right", with which a page in a booklet is turned over with its back positioned on the right of the booklet, "open to left", with which a page in a booklet is turned over with its back positioned on the left of the booklet, and "open to top", with which a page in a booklet is turned over with its back positioned on the top of the booklet.

In the case of dividing a sheet, the same images can be formed on the sheet to be juxtaposed along the direction orthogonal to the conveyance direction. The number of times of folding can be calculated according to the utilization efficiency determination flow S200 in FIG. 5 or can be entered by the user via the operation unit 1. The opening direction can be entered by the user via the operation unit 1.

An orientation of images in the case of once-folding (where the number of times of folding is 1) will now be described below with reference to FIGS. 9A through 9C.

Figure 9A:
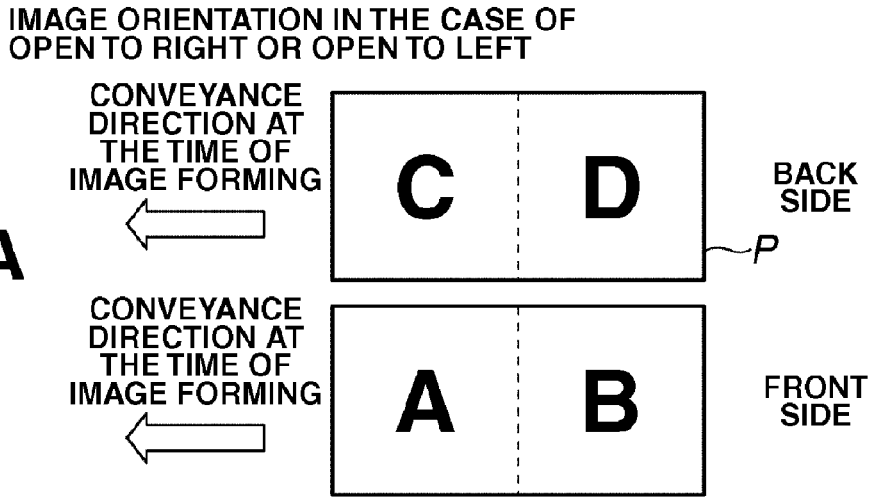
FIGS. 9A through 9C illustrate an image forming orientation and an image position in the case of once-folding according to an exemplary embodiment of the present invention.

FIG. 9A illustrates the orientation of images in the case of "open to right" or "open to left". An arrow in FIG. 9A indicates the conveyance direction at the time of forming an image. "Back side" and "front side" in FIG. 9A indicate a state of the back side and the front side at the time of discharging the sheet to the finisher 500. Symbols "A", "B", "C", and "D" each indicate an image position. The images are formed in the order such that images are formed on the back side first and, after the sheet is reversed, images are formed on the front side.

Figure 9B:
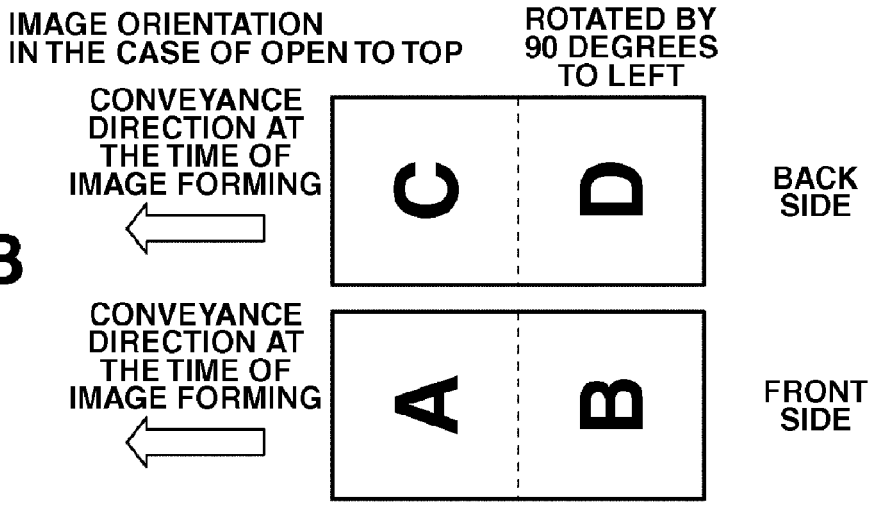

FIG. 9B illustrates an image orientation in the case of "open to top". In the case of "open to top", the image orientation is rotated to the left by 90 degrees.

Figure 9C:
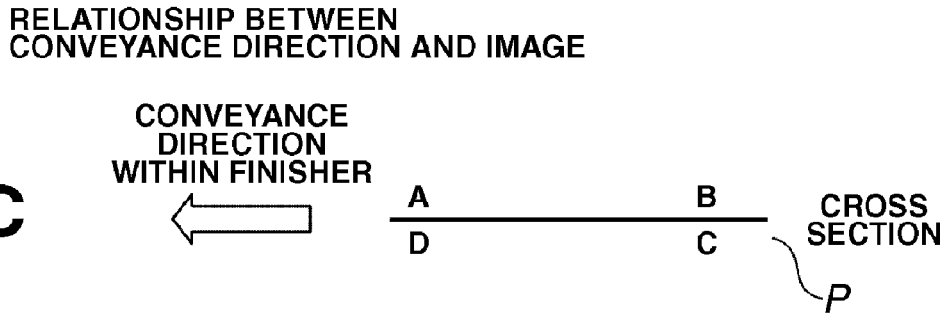

FIG. 9C is a cross section illustrating an image position at the time of conveyance in the finisher 500. As illustrated in FIG. 9C, images on the leading edge are formed at positions "A" and "D" on the sheet.

The page allocation in the case of "open to left" or "open to top" in once-folding (where the number of times of folding is 1) will now be described below with reference to FIGS. 10A and 10B.

Figure 10A:
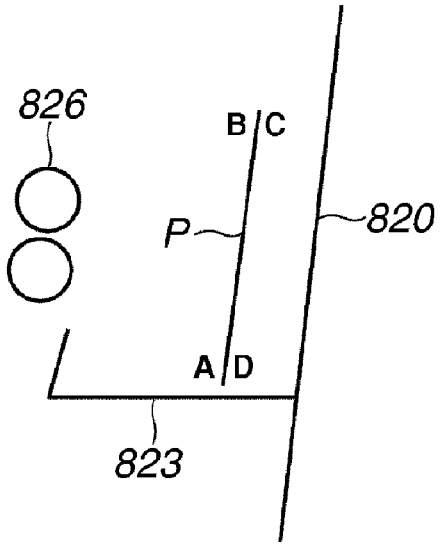
FIGS. 10A through 10C illustrate a page allocation in the case of once-folding according to an exemplary embodiment of the present invention.
Figure 10B:
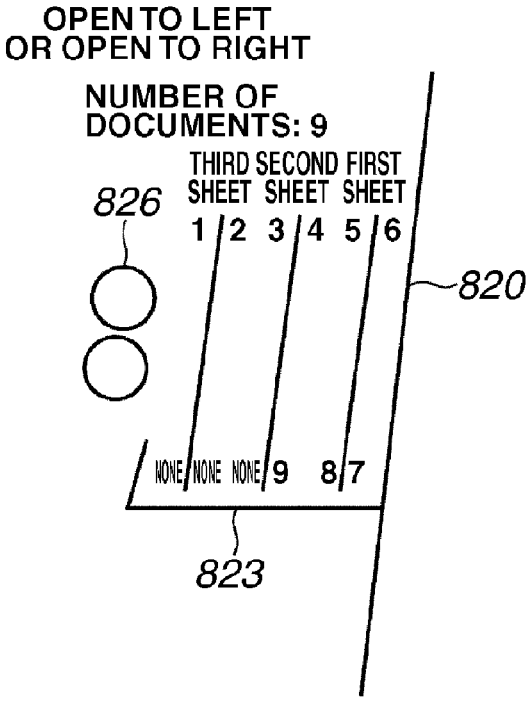

FIG. 10A is a cross section illustrating an image position when the sheet is stacked on the bookbinding processing tray 820. As illustrated in FIG. 10A, images on the edge of the sheet close to the sheet positioning member 823 are formed at positions "A" and "D".

The CPU 153 first calculates the number of sheets on which images are to be formed (K). The number of sheets on which images are to be formed (K) is indicated by a value obtained by an expression "the number of documents/4", while rounding fractional figures (K=roundup (the number of documents/4)).

Then, the CPU 153 performs allocation on each sheet on which images are to be formed considering which page is allocated to each image position of the sheet on which images are formed at four positions (A, B, C, and D). A print page for each image position can be calculated according to the following expressions (1) through (4). However, if the calculated value exceeds the number of documents, no image is formed at the image position:

$$\text{The image position A: } 2\times(K+N) \quad (1)$$

$$\text{The image position B: } 2\times(K-N)+1 \quad (2)$$

$$\text{The image position C: } 2\times(K-N)+2 \quad (3)$$

$$\text{The image position D: } 2\times(K+N)-1 \quad (4)$$

where "N" denotes the order of discharge of a sheet from the image forming apparatus body 1100 (the first sheet, the second sheet, . . . and the N-th sheet), and "K" denotes the number of sheets on which images are to be formed.

For example, when the number of documents is 9, a resulting value of round-up of 9/4 is 3, and thus the number of sheets on which images are to be formed is 3. With respect to the page allocation, as illustrated in FIG. 10B, an image at the image position A on the first sheet is allocated to page 8, an image at the image position B is allocated to page 5, an image at the image position C is allocated to page 6, and an image at the image position D is allocated to page 7. For the second and third sheets, a similar allocation is performed as illustrated in FIG. 10B.

Figure 10C:
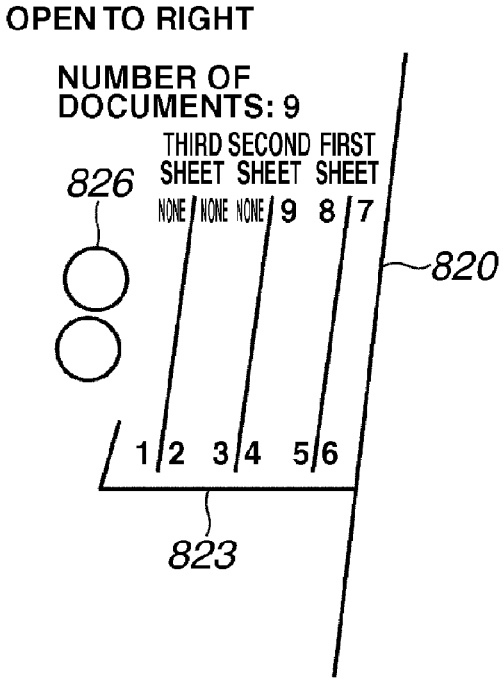

The page allocation in the case of "open to right" in once-folding (where the number of times of folding is 1) will now be described below with reference to FIGS. 10A and 10C.

FIG. 10A is a cross section illustrating an image position when the sheet is stacked on the bookbinding processing tray 820. As illustrated in FIG. 10A, images on the edge of the sheet close to the sheet positioning member 823 are formed at positions "A" and "D".

The CPU 153 calculates the number of sheets on which images are to be formed (K). The number of sheets on which images are to be formed (K) is indicated by a value obtained by an expression "the number of documents/4", while rounding fractional figures (K=roundup (the number of documents/4)).

Then, the CPU 153 performs allocation on each sheet on which images are to be formed considering which page is allocated to each image position of the sheet on which images are formed at four positions.

A print page for each image position can be calculated according to the following expressions (5) through (8). However, if the calculated value exceeds the number of documents, no image is formed at the image position:

$$\text{The image position A: } 2\times(K-N)+1 \quad (5)$$

$$\text{The image position B: } 2\times(K+N) \quad (6)$$

$$\text{The image position C: } 2\times(K+N)-1 \quad (7)$$

$$\text{The image position D: } 2\times(K-N)+2 \quad (8)$$

where "N" denotes the order of discharge of a sheet from the image forming apparatus body 1100 (the first sheet, the second sheet, . . . and the N-th sheet), and "K" denotes the number of sheets on which images are to be formed.

For example, when the number of documents is 9, a resulting value of round-up of 9/4 is 3, and thus the number of sheets on which images are to be formed is 3. With respect to the page allocation, as illustrated in FIG. 10C, an image at the image position A on the first sheet is allocated to page 5, an image at the image position B is allocated to page 8, an image at the image position C is allocated to page 7, and an image at the image position D is allocated to page 6. For the second and third sheets, a similar allocation is performed as illustrated in FIG. 10C.

An orientation of images in the case of twice-folding (where the number of times of folding is 2) will now be described below with reference to FIGS. 11 through 11D.

Figure 11A:
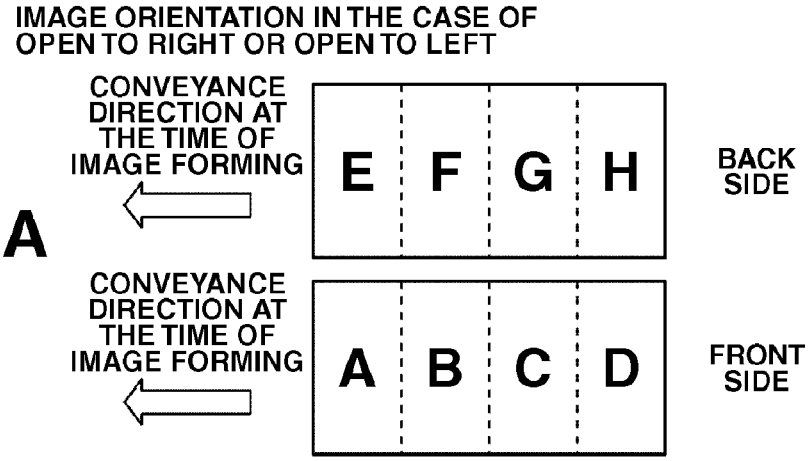
FIGS. 11A through 11D illustrate an image forming orientation and an image position in the case of twice-folding according to an exemplary embodiment of the present invention.

FIG. 11A illustrates the orientation of images in the case of "open to right" or "open to left". An arrow in FIG. 11A indicates the conveyance direction at the time of forming an image. "Back side" and "front side" in FIG. 11A indicate a state of the back side and the front side at the time of discharging a sheet to the finisher 500. Symbols "A", "B", "C", "D", "E", "F", "G", and "H" each indicate an image position. The images are formed in the order such that an image is formed on the back side first and after the sheet is reversed, an image is formed on the front side.

Figure 11B:
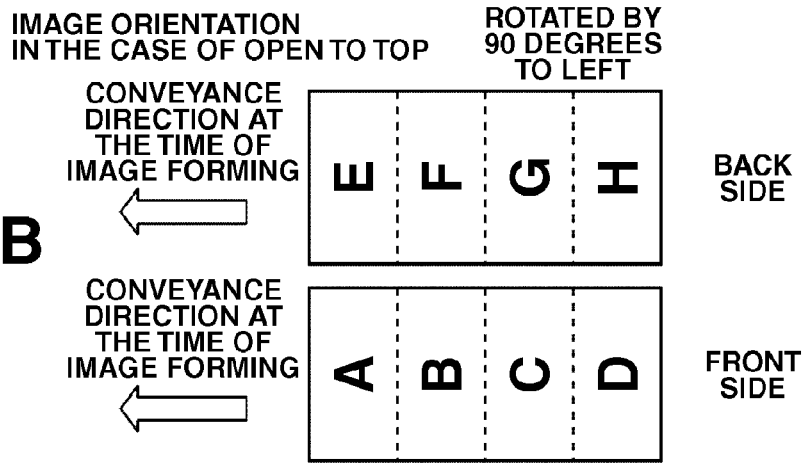

FIG. 11B illustrates an image orientation in the case of "open to top". In the case of "open to top", the image orientation is rotated to the left by 90 degrees.

Figure 11C:
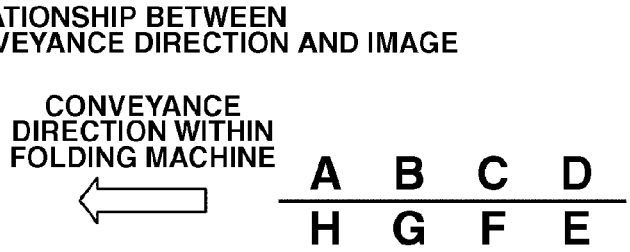
Figure 11D:
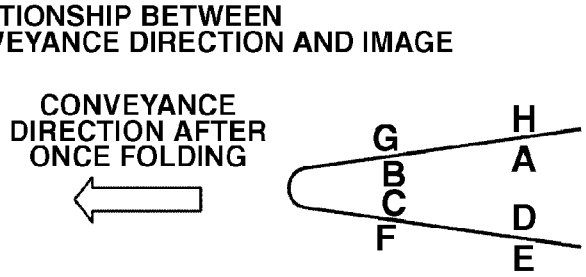

FIG. 11C is a cross section illustrating an image position at the time of conveyance when the sheet enters the folding machine 400. As illustrated in FIG. 11C, images on the leading edge are formed at positions "A" and "H" on the sheet. FIG. 11D is a cross section illustrating an image position during conveyance after the sheet is once-folded with the folding machine 400. As illustrated in FIG. 11D, a folded portion of the sheet becomes a leading edge thereof.

The page allocation in the case of "open to left" or "open to top" in twice-folding (where the number of times of folding is 2) will now be described below with reference to FIGS. 12A and 12B.

Figure 12A:
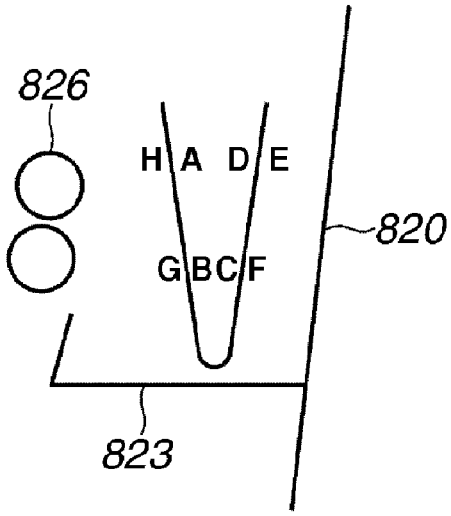
FIGS. 12A through 12C illustrate a page allocation in the case of twice-folding according to an exemplary embodiment of the present invention.
Figure 12B:
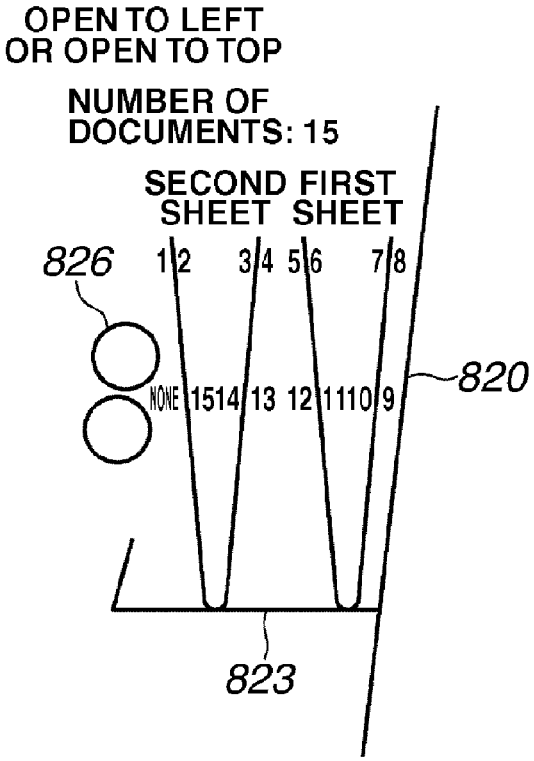

FIG. 12A is a cross section illustrating an image position when the sheet is stacked on the bookbinding processing tray 820. As illustrated in FIG. 12A, the sheet is stacked on the bookbinding processing tray 820 so that the folded portion is located close to the sheet positioning member 823.

The CPU 153 first calculates the number of sheets on which images are to be formed (K). The number of sheets on which images are to be formed (K) is indicated by a value obtained by an expression "the number of documents/8", while rounding fractional figures (K=roundup (the number of documents/8)).

Then, the CPU 153 performs allocation on each sheet on which images are to be formed considering which page is allocated to each image position of the sheet on which images are formed at eight positions (A, B, C, D, E, F, G, and H).

A print page for each image position can be calculated according to the following expressions (9) through (16). However, if the calculated value exceeds the number of documents, no image is formed at the image position:

The image position A: $4\times(K-N)+2$ (9)

The image position B: $4\times(K+N)-1$ (10)

The image position C: $4\times(K+N)-2$ (11)

The image position D: $4\times(K-N)+3$ (12)

The image position E: $4\times(K-N)+4$ (13)

The image position F: $4\times(K+N)-3$ (14)

The image position G: $4\times(K+N)$ (15)

The image position H: $4\times(K-N)+1$ (16)

where "N" denotes the order of discharge of a sheet from the image forming apparatus body 1100 (the first sheet, the second sheet, . . . and the N-th sheet), and "K" denotes the number of sheets on which images are to be formed.

For example, when the number of documents is 15, a resulting value of round-up of 15/8 is 2, and thus the number of sheets on which images are to be formed is 2. With respect to the page allocation, as illustrated in FIG. 12B, an image at the image position A on the first sheet is allocated to page 6, an image at the image position B is allocated to page 11, an image at the image position C is allocated to page 10, and an image at the image position D is allocated to page 7. Furthermore, an image at the image position E on the first sheet is allocated to page 8, an image at the image position F is allocated to page 9, an image at the image position G is allocated to page 12, and an image at the image position H is allocated to page 5. For the second sheet, a similar allocation is performed as illustrated in FIG. 12B.

Figure 12C:
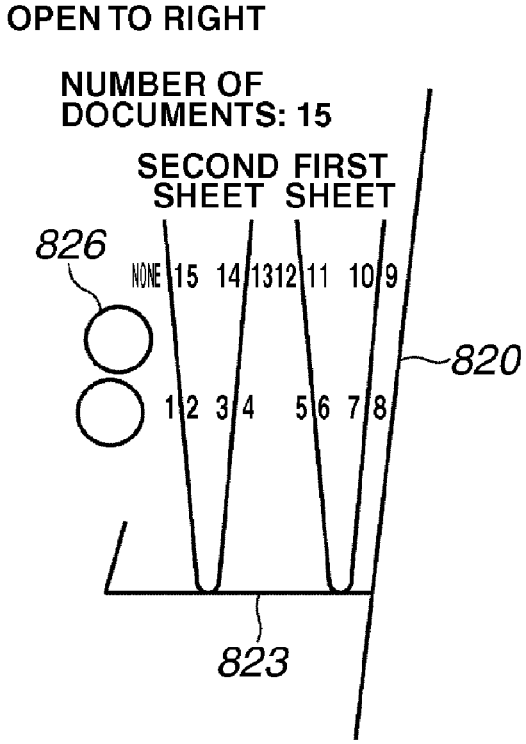

The page allocation in the case of "open to right" in twice-folding (where the number of times of folding is 2) will now be described below with reference to FIGS. 12A and 12C.

FIG. 12A is a cross section illustrating an image position when the sheet is stacked on the bookbinding processing tray 820. As illustrated in FIG. 12A, the sheet is stacked on the bookbinding processing tray 820 so that the folded portion is located close to the sheet positioning member 823.

The CPU 153 first calculates the number of sheet on which images are to be formed (K). The number of sheets on which images are to be formed (K) is indicated by a value obtained by an expression "the number of documents/8", while rounding fractional figures (K=roundup (the number of documents/8)).

Then, the CPU 153 performs allocation on each sheet on which images are to be formed considering which page is allocated to each image position of the sheet on which images are formed at eight positions (A, B, C, D, E, F, G, and H).

A print page for each image position can be calculated according to the following expressions (17) through (24). However, if the calculated value exceeds the number of documents, no image is formed at the image position:

The image position A: $4\times(K+N)-1$ (17)

The image position B: $4\times(K-N)+2$ (18)

The image position C: $4\times(K-N)+3$ (19)

The image position D: $4\times(K+N)-2$ (20)

The image position E: $4\times(K+N)-3$ (21)

The image position F: $4\times(K-N)+4$ (22)

The image position G: $4\times(K-N)+1$ (23)

The image position H: $4\times(K+N)$ (24)

where "N" denotes the order of discharge of a sheet from the image forming apparatus body 1100 (the first sheet, the second sheet, . . . and the N-th sheet), and "K" denotes the number of sheets on which images are to be formed.

For example, when the number of documents is 15, a resulting value of round-up of 15/8 is 2, and thus the number of sheets on which images are to be formed is 2. With respect to the page allocation, as illustrated in FIG. 12C, an image at the image position A on the first sheet is allocated to page 11, an image at the image position B is allocated to page 6, an image at the image position C is allocated to page 7, and an image at the image position D is allocated to page 10. Furthermore, an image at the image position E on the first sheet is allocated to page 9, an image at the image position F is allocated to page 8, an image at the image position G is allocated to page 5, and an image at the image position H is allocated to page 12. For the second sheet, a similar allocation is performed as illustrated in FIG. 12B.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-161535 filed Jun. 9, 2006, which is hereby incorporated by reference herein in its entirety.

What is claimed is:

1. An image forming system comprising:

a sheet feeding unit configured to be capable of feeding sheets of different sheet sizes;

a cutting unit configured to cut an edge portion of a fed sheet;

a folding unit configured to fold the sheet;

a calculation unit configured to calculate a sheet utilization efficiency for each of the different sheet sizes based on an area of the sheet before cutting and the area of the sheet after cutting the edge portion by the cutting unit; and a display unit configured to display a result of the calculation unit with respect to the sheet utilization efficiency for each of the different sheet sizes, wherein the calculation unit calculates the sheet utilization efficiency based on the area of the sheet before cutting by the cutting unit and folding by the folding unit, and the area of the sheet after folding by the folding unit and cutting the edge portion by the cutting unit.

2. An image forming system according to claim 1, wherein the calculation unit calculates the sheet utilization efficiency based on the area of the sheet before cutting by the cutting unit and folding by the folding unit, the area of the sheet after folding the sheet by the folding unit and cutting the edge portion of the folded sheet by the cutting unit, and the number of times of folding.

3. An image forming system according to claim 1, further comprising:

a sheet size selection unit configured to select a sheet size whose sheet utilization efficiency is highest of the different sheet sizes based on the result of calculation by the calculation unit.

4. An image forming system according to claim 1, wherein the cutting unit cuts an edge portion of the sheet after being folded by the folding unit, and wherein the calculation unit calculates the area of the sheet after cutting the edge portion by the cutting unit based on a number of times of folding by the folding unit and a distance between a cutting line along which the cutting unit performs cutting and an edge of the sheet.

5. An image forming system according to claim 1, further comprising:

an image forming unit configured to form an image on a sheet;

a first folding unit configured to fold the sheet having the image formed by the image forming unit at a portion between a plurality of pages;

a second folding unit configured to fold the sheet folded by the first folding unit; and a binding unit configured to bind a plurality of sheets folded by the first folding unit at a portion between a plurality of pages, and wherein the second folding unit folds a sheet stack bound by the binding unit at a portion of binding by the binding unit.

6. An image forming system according to claim 1, further comprising:

a binding unit configured to bind the sheet which is folded by the folding unit, wherein the folding unit again folds the sheet which is bound by the binding unit at a portion of binding by the binding unit, and wherein the cutting unit cuts an edge portion opposite to an edge at which the binding unit bound the sheet and to cut off the edge portion, which includes a folded portion formed by folding the sheet by the folding unit, from the sheet bound by the binding unit.

7. An image forming system according to claim 6, further comprising:

an image forming unit configured to form images for a plurality of pages on one sheet; and a determining unit configured to determine a position of an image to be formed by the image forming unit on a sheet for each image on the plurality of pages such that the images on the plurality of pages are arranged in sequence in a bookbound state in which the edge at which the binding unit binds the sheet is used as a back portion after the sheet is cut by the cutting unit.

8. An image forming system comprising:

a sheet feeding unit configured to feed sheets of different sheet sizes;

a cutting unit configured to cut an edge portion of a fed sheet;

a folding unit configured to fold the sheets a number of times;

a calculation unit configured to calculate a sheet utilization efficiency for each of the different sheet sizes based on the difference between an area of the sheet before cutting and the area of the sheet after cutting the edge portion by the cutting unit; and a sheet size selection unit configured to select a size of sheet to be fed based on a result of calculation with respect to the sheet utilization efficiency for each of the different sheet sizes, wherein the sheet size selection unit selects a size of sheet to be fed based on the area of the sheet before cutting by the cutting unit and folding by the folding unit, and the area of the sheet after folding the sheet by the folding unit and cutting the edge portion by the cutting unit.

9. An image forming system according to claim 8, wherein the sheet size selection unit selects a size of sheet to be fed based on the area of the sheet before cutting by the cutting unit and folding by the folding unit, the area of the sheet after folding the sheet by the folding unit and cutting the edge portion by the cutting unit, and the number of times of folding.

10. An image forming system, comprising:

a folding unit configured to determine a number of times to fold a sheet based at least upon a length of the sheet in a conveyance direction and a cutting margin;

a division unit configured to determine a number of times to divide the sheet based at least upon a length of the sheet in a direction orthogonal to the conveyance direction and the cutting margin subsequent to determining the number of times to fold the sheet;

a cutting unit configured to cut an edge portion of the sheet subsequent to the division unit determining the number of times to divide the sheet; and a calculation unit configured to calculate a sheet utilization efficiency based on an area of the sheet before cutting and the area of the sheet after cutting the edge portion by the cutting unit.

11. An image forming system according to claim 10, further comprising:

a sheet feeding unit configured to feed sheets of different sheet sizes, wherein the calculation unit calculates the sheet utilization efficiency for each of the different sheet sizes.

12. An image forming system according to claim 10, further comprising:

a sheet size selection unit configured to select a sheet size whose sheet utilization efficiency is highest of the different sheet sizes based on a result of the calculation by the calculation unit.

13. An image forming system according to claim 10, further comprising:

a display unit configured to display a result of the calculation unit with respect to the sheet utilization efficiency for each of the different sheet sizes.

14. An image forming system according to claim 10, further comprising:

an image forming unit configured to form an image on a sheet;

a first folding unit configured to fold the sheet having the image formed by the image forming unit at a portion between a plurality of pages; and a second folding unit configured to fold the sheet folded by the first folding unit, wherein the image forming system further comprises a binding unit configured to bind a plurality of sheets folded by the first folding unit at a portion between a plurality of pages, and wherein the second folding unit folds a sheet stack bound by the binding unit at a portion of binding by the binding unit.

15. An image forming system according to claim 10, wherein the folding unit folds the sheet; and a binding unit configured to bind the sheet that is folded by the folding unit, wherein the folding unit again folds the sheet bound by the binding unit at a portion of binding by the binding unit, and wherein the cutting unit cuts an edge portion opposite to an edge at which the binding unit bound the sheet and to cut off the edge portion, which includes a folded portion formed by folding the sheet by the folding unit, from the sheet bound by the binding unit.

16. An image forming system according to claim 15, further comprising:

an image forming unit configured to form images for a plurality of pages on one sheet; and a determining unit configured to determine a position of an image to be formed by the image forming unit on a sheet for each image on the plurality of pages such that the images on the plurality of pages are arranged in sequence in a bookbound state in which the edge at which the binding unit binds the sheet is used as a back portion after the sheet is cut by the cutting unit.

* * * * *